US008152587B1

(12) United States Patent
Brown

(10) Patent No.: US 8,152,587 B1
(45) Date of Patent: Apr. 10, 2012

(54) NOVELTY TOY ACCESSORY WITH CONCEALED COMPARTMENT INSERT TEMPLATES

(76) Inventor: Lisa M. Brown, New Orleans, LA (US)

( * ) Notice: Subject to any disclaimer, the term of this patent is extended or adjusted under 35 U.S.C. 154(b) by 360 days.

(21) Appl. No.: 12/653,439

(22) Filed: Dec. 14, 2009

Related U.S. Application Data

(60) Provisional application No. 61/201,574, filed on Dec. 13, 2008.

(51) Int. Cl.
*A63H 3/00* (2006.01)

(52) U.S. Cl. ..... 446/73; 446/369; 446/75; 446/76; 446/69; 206/216

(58) Field of Classification Search ..... 446/369–372, 446/71–73, 75–77, 69, 487–488; 40/124.06, 40/743; 229/116.1, 103.2–103.3, 102.01, 229/102.5; 206/499, 774, 738–739, 216
See application file for complete search history.

(56) References Cited

U.S. PATENT DOCUMENTS

| | | | | | |
|---|---|---|---|---|---|
| 1,479,328 | A | * | 1/1924 | Sinel | 229/103.2 |
| 1,519,051 | A | * | 12/1924 | Rayner | 206/216 |
| 1,710,679 | A | * | 4/1929 | Pels | 446/73 |
| 2,052,594 | A | * | 9/1936 | Antel | 446/73 |
| 3,946,863 | A | * | 3/1976 | Glasband et al. | 206/216 |
| 4,438,579 | A | * | 3/1984 | Engel | 40/743 |
| 5,059,149 | A | * | 10/1991 | Stone | 446/73 |
| 5,094,621 | A | * | 3/1992 | Friedel | 434/236 |
| 5,324,201 | A | * | 6/1994 | Friedel | 434/236 |
| 5,379,886 | A | * | 1/1995 | Brauner et al. | 206/216 |
| 5,807,155 | A | * | 9/1998 | Divvleeon | 446/73 |
| 5,984,755 | A | * | 11/1999 | Avey | 446/75 |
| 6,173,833 | B1 | * | 1/2001 | Strehlow | 206/216 |
| 6,755,712 | B2 | * | 6/2004 | Morris | 446/98 |
| 6,823,988 | B2 | * | 11/2004 | Ryan et al. | 206/216 |
| 7,146,760 | B2 | * | 12/2006 | Yiu | 40/743 |
| 2001/0004577 | A1 | * | 6/2001 | Lewis | 446/72 |
| 2001/0046828 | A1 | * | 11/2001 | Morris | 446/98 |
| 2002/0022431 | A1 | * | 2/2002 | Schneider | 446/73 |
| 2005/0274049 | A1 | * | 12/2005 | Schmidt | 40/124.09 |
| 2006/0089076 | A1 | * | 4/2006 | Jacobson | 446/71 |
| 2010/0075566 | A1 | * | 3/2010 | Katz | 446/75 |

FOREIGN PATENT DOCUMENTS

| | | | | |
|---|---|---|---|---|
| JP | 2003299883 | A | * | 10/2003 |
| JP | 2005137576 | A | * | 6/2005 |

* cited by examiner

*Primary Examiner* — Gene Kim
*Assistant Examiner* — Matthew B Stanczak

(57) ABSTRACT

A novelty toy having a body with a concealed basket compartment creating a cavity to house, store, secure, and conceal novelty items. The toy further includes a detachable cover to conceal the cavity when the cover is attached to the body and reveal the cavity when removed. The novelty toy also includes a removably changeable housing insert assembly embedded within the cavity having several attachment components which include a light source, a changeable housing insert template, a changeable inner insert template, an insert cover template and an insert ramp accessory. The cavity and insert assembly is used to display, store, house, secure templates with indicia including but not limited to arts and crafts, traditional family, learning and sport activity games. The toy body may be in the form of an animal-like, humanoid, holiday figure, mascot, icon or any characters attracted, known or recognizable to children or adults.

18 Claims, 10 Drawing Sheets

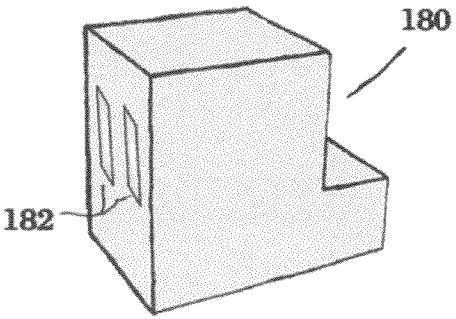
FIG. 15B
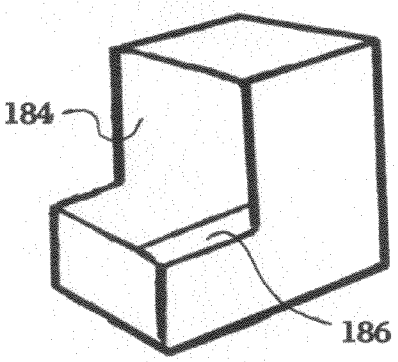
FIG. 15C
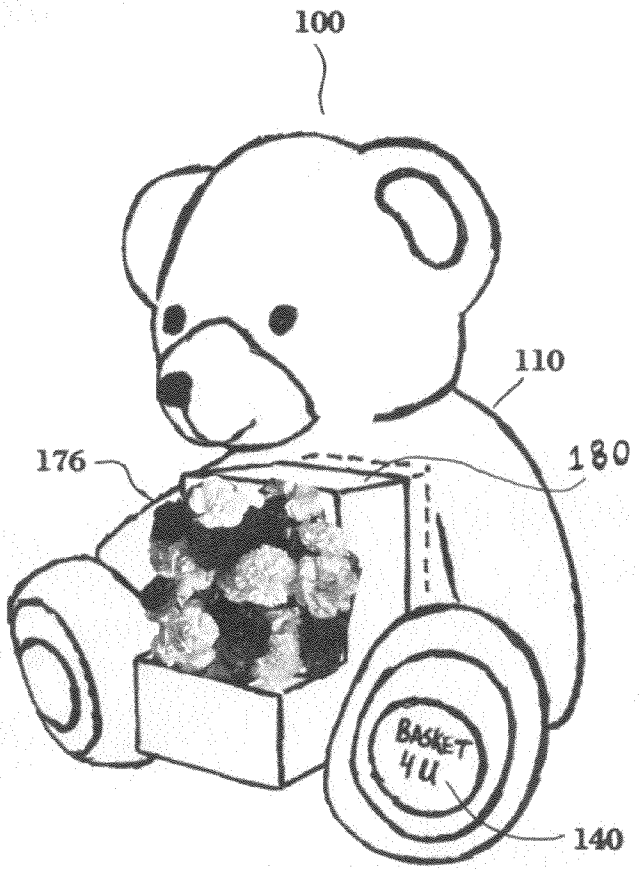
FIG. 15A
FIG. 15

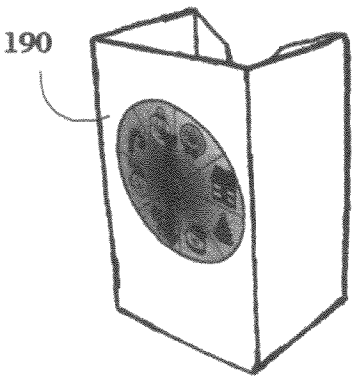
FIG. 16A
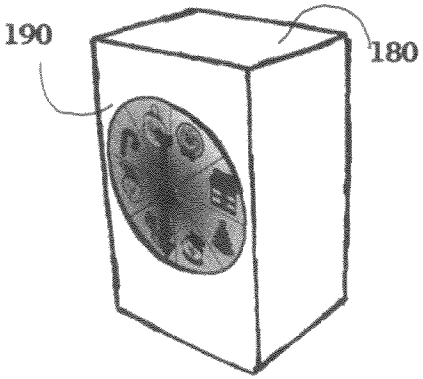
FIG. 16B
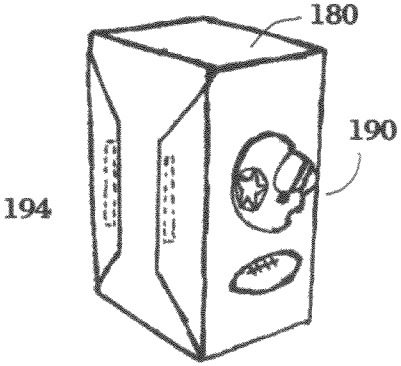
FIG. 16C
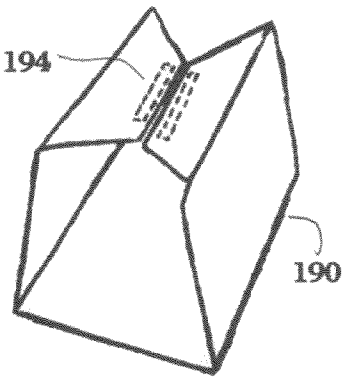
FIG. 16D
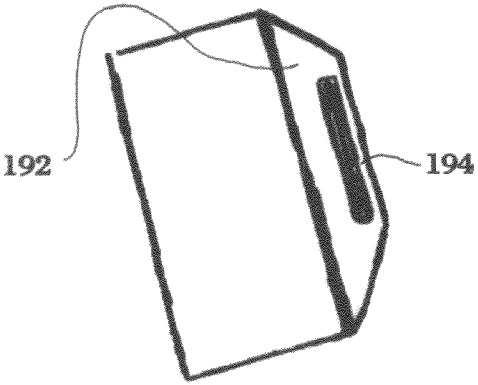
FIG. 16E
FIG. 16

NOVELTY TOY ACCESSORY WITH CONCEALED COMPARTMENT INSERT TEMPLATES

This application claims priority benefit of provisional application Ser. No. 61/201,574 filed on Dec. 13, 2008, incorporated herein by reference as if set forth in full below.

BACKGROUND OF THE INVENTION

I. Field of the Invention

The present invention relates generally to stuffed or plush toys and more specifically it relates to a multi-functional novelty plush toy accessory having a concealed basket compartment in its body, a compartment changeable housing insert assembly and a detachable cushion cover with an inner pocket. The compartment changeable housing insert assembly is to removably store, secure, house, package, and/or conceal gifts, arts and crafts, or novelty items therein and uses a variety of assorted insert templates to be created, transformed, shaped or used for learning and educational settings, parties, tailgating games, sporting activities, festivals, corporate, social or cultural events. Also detachable button or patches attached on its body.

II. Description of the Related Art

It can be appreciated that stuffed or plush toys have been in use for years. Typically, stuffed or plush toys are comprised of different types of stuffed or plush toys with a variety of functions. Some of these functioning stuffed toys store within them voice modules with press-buttons stored or located somewhere throughout the body to activate the voice. Other stuffed or plush toys may consist of such as, without limitation scented fragrance cartridge, capsules, or material stored within a chamber of the body, or a recording apparatus stored inside to repeat ones voice or play prerecorded stories, songs or a voice coming from a teddy bear or characters such as, without limitation to Mickey Mouse, Bugs Bunny, Sesame Street Characters, Barney, or SpongeBob, just to name a few. Whereas, a variety type of stuff toys have been used to be placed, secured, packaged, stored or concealed inside of traditional or conventional gift baskets.

However, these traditional or conventional gift baskets are not placed, secured, packaged, stored or concealed inside of traditional or conventional stuff or plush toys for presentation of gifts or novelty items therein. Once presented, these gift baskets are normally placed away in storage for keepsakes purposes and never to be used again.

Furthermore, the conventional stuffed or plush toys do not hold, package, conceal or store gift basket novelty or gift items inside of their compartment such as but not limited to Boxed Chocolates or Candy, Flowers, Jewelry, Picture Frame, Candles, Travel Sized Items, Garments or Clothing Items, Trinkets or Figurines, Collector's Items, Small Electronic Devices, Inspirational Gifts, Graduation Items, Wedding or Anniversary Gifts, Diaries, Journals and/or Newborn Baby Accessories just to name a few.

Neither do they have a compartment changeable insert template to change the features or background of the concealed compartment for different uses such as educational settings, arts and crafts, nor can games be used as entertaining or activity play or participation.

Furthermore, traditional or conventional stuffed or plush toys do not have a cover with an inner pocket that coincides with its body to concealed, hide and secure gift or novelty items inside of it compartment or inner pocket, thus giving the impression that nothing is inside of its body cavity.

Furthermore, traditional or conventional stuffed or plush toys do not have multifunctional usages in one stuffed or plush toy having changeable inserts for those settings involving educational and sporting games that features multiple activities in one setting along with the option of flexibility for, such as but not limited to, arts and crafts, "bingo", "flash cards", "tic-tac-toe", "pin the tail on the . . . ", football, baseball, basketball, cricket, golf, bowling, dartboard and/or soccer, all with one novelty toy.

Thus, there is a need for a multifunctional stuffed or plush toy accessory with a concealed basket compartment that includes a detachable cover to house, store, secure, package, or conceal novelty items, such as a gift baskets and offer the option to use a compartment changeable housing insert assembly for arts and crafts, educational, traditional sporting activities, corporate, social or cultural events, or games activities. And have detachable buttons or patches on its body.

Furthermore, traditional or conventional stuffed or plush toys do not have detachable Velcro backed buttons or patches that can be attached its body and/or removed as desired.

SUMMARY OF THE INVENTION

In view of the foregoing, the present invention provides a hybrid multi-functional apparatus comprising a toy body having a concealed basket compartment to secure and store a standalone gift or novelty source within the concealed basket compartment or accept a changeable housing insert with insert templates, and a cover with an inner pocket to cover and conceal the concealed basket compartment when the cover is in a closed state and reveals the concealed basket compartment when the cover is in an open state. The multi-functional apparatus also includes detachable backed buttons or patches on its body for display, and can be removed and stored inside of the concealed basket compartment or the inner pocket located on the cover's inner surface.

In another configuration, the present invention provides an apparatus comprising a toy body having a concealed basket compartment to house and package a standalone gift or novelty source within the concealed basket compartment and a cover with an inner pocket to cover and conceal the concealed basket compartment when the cover is in a closed state and reveals the concealed basket compartment and standalone gift or novelty source when the cover is in an open state. The apparatus also includes detachable buttons or patches on its body.

Furthermore, the present invention provides a hybrid stuffed or plush toy having a changeable housing insert with optional changeable inner insert templates, insert cover templates, and an insert ramp accessory for educational or learning settings, arts and crafts, traditional games for sports, family, entertainment, religious, community, social or cultural activities.

The present invention provides a stuffed or plush toy having a concealed basket compartment in its body, with a detachable cushion flap with an inner pocket used to help conceal, store, secure, housed, or package gifts or novelty items.

In accordance with the present invention, there is provided a stuffed or plush toy accessory configured in the form of an animal-like, holiday symbol or icon, humanoid or other characters.

Another object of the invention to provide a stuffed or plush toy accessory with a concealed stuffing insert opening within it to allow entry access for a stuffing machine nozzle or hose to stuff the toy's body with filling.

There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Another object of the invention is to provide a novelty toy accessory that has a detachable cushion flap with an inner pocket that can be fasten over the opening of the concealed compartment to cover, help, secure and protect the gifts or novelty item stored within the compartment.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views.

FIG. 15A is a front perspective view of the novelty toy accessory displaying a floral arrangement inside of a changeable housing insert template without its accessories and/or attachments, and a perspective front view of a detachable button or patch attached to the body of the novelty toy.

FIG. 15B is a back perspective view of the Changeable housing insert template displaying fasteners which are used to attach and secure Changeable Insert Cover Templates in place.

FIG. 15C is a front perspective view of the Changeable housing insert template displaying the cavity which is used to place, house, store, insert, hold and secure gifts, toys, arrangements, foods items, perishable and non-perishable novelty items inside of its compartment.

FIG. 16A is a front perspective view of the Changeable Insert Cover Template used to place or cover the opening compartment cavity of Changeable housing Insert Template.

FIG. 16B is a front perspective view of the Changeable Insert Cover Template attached or affixed to the Changeable housing Insert Template.

FIG. 16C is a rear perspective view showing the Changeable Insert Cover Template fasteners attached or affixed to the Changeable housing Insert Template's fasteners.

FIG. 16D is a top perspective view showing the Changeable Insert Cover Template facing in a downward position with its fasteners shown inside of its flap.

FIG. 16E is a cross-sectional view along the plane of FIG. 16A and a partial perspective, inside view of a Changeable Insert Cover Template's displaying a fastener used to attach or affix to the fasteners located on the Changeable housing Insert Template.

FIG. 17A through FIG. 171 are sample views of Compartment Changeable Housing Insert Templates displaying various traditional games for but not limited to, holidays, sports and learning activities designed to be inserted inside of the Concealed Basket Compartment.

DETAILED DESCRIPTION OF THE INVENTION

Figure 2:
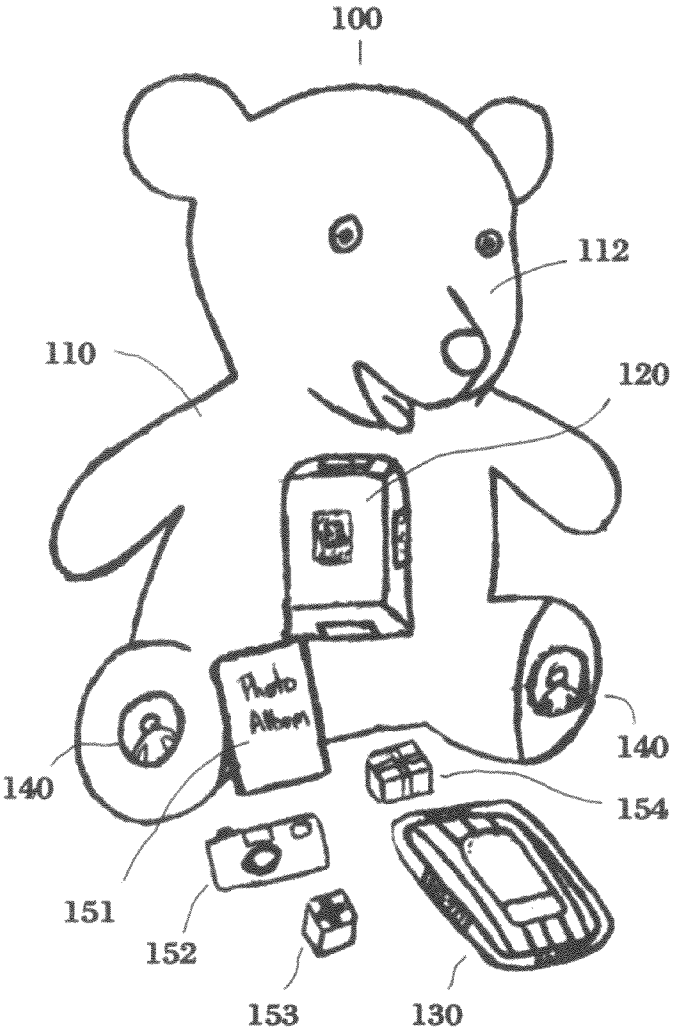
FIG. 2 is an exploded view of the novelty toy accessory displaying the opening of the concealed basket compartment, stuffing insert opening, gift or novelty items outside of the basket compartment, a cushion flap detached and detachable buttons attached to body of the novelty toy.
Figure 1:
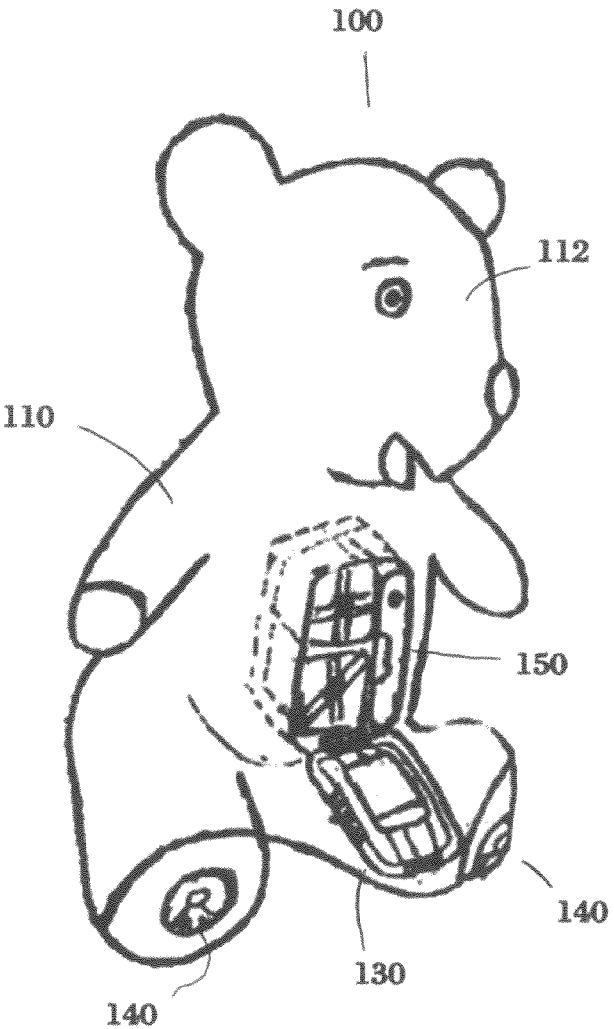
FIG. 1 is a perspective view of the novelty plush toy accessory of the present invention displaying gift or novelty items packaged, stored or housed within the concealed basket compartment with detachable cushion flap attached to bottom of the concealed basket compartment.

Turning now descriptively to the drawings, in which similar reference characters denote similar elements throughout the several views, the attached figures illustrate a multi-functional novelty toy accessory which comprises of having a concealed basket compartment with compartment changeable housing insert assembly to receive, store, house, secure, package or conceal gifts, sports or novelty items arts and crafts games for educational or learning settings, traditional games for sports, family, entertainment, religious, community, social or cultural activities therein, and a stuffing insert opening in its body, along with a detachable cushion flap that features an inner secret pocket, and detachable button or patches. The detachable cushion flap can be closed or open while a novelty item is housed, secured, concealed or stored and the detachable button or patches can be detached and stored or placed inside of the basket compartment or inner secret pocket.

Referring now to the drawings, and specifically to FIGS. 1-17I, the novelty toy accessory is generally denoted by the reference numeral 100. The novelty toy accessory 100 includes a body 110 having an outer covering 112 which is made from safe material suitable for the usage by children. The material may be, such as without limitation, vinyl, faux fur, fabric shell with filling, foamed rubber, polyurethane, or other fitting material generally used in the manufacturing of stuffed or plush toys or cushioned toy product. The outer covering 112 is contoured to form any attractable animal-like, holiday symbol, icon, humanoid or other characters recognizable or known to children or adults, the characters could include such as without limitation, Entertainers, Sport Figures/Icons, Mascots, Holiday Figures/Icons, Mickey Mouse, Winnie the Pooh, Bugs Bunny, Big Bird, Barney, SpongeBob SquarePants, or any other characters created by Walt Disney, Inc., Warner Brothers, Public Broadcasting Service (PBS), or Nickelodeon.

Figure 6:
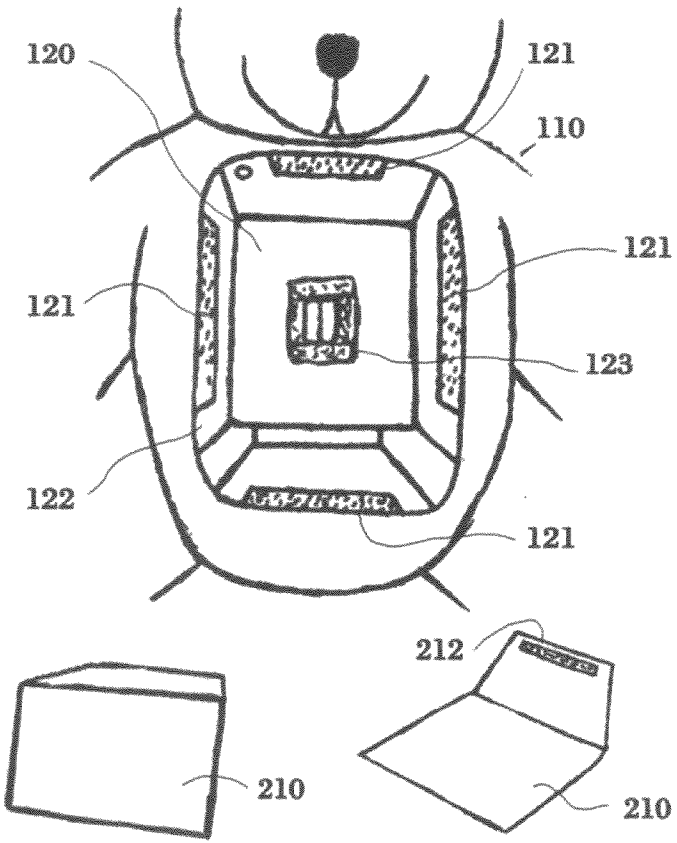
FIG. 6 is a front view of the novelty toy accessory displaying the opening of the concealed basket compartment showing the internal fasteners and the stuffing filling device, and a top and bottom view of the insert ramp accessory.
Figure 12:
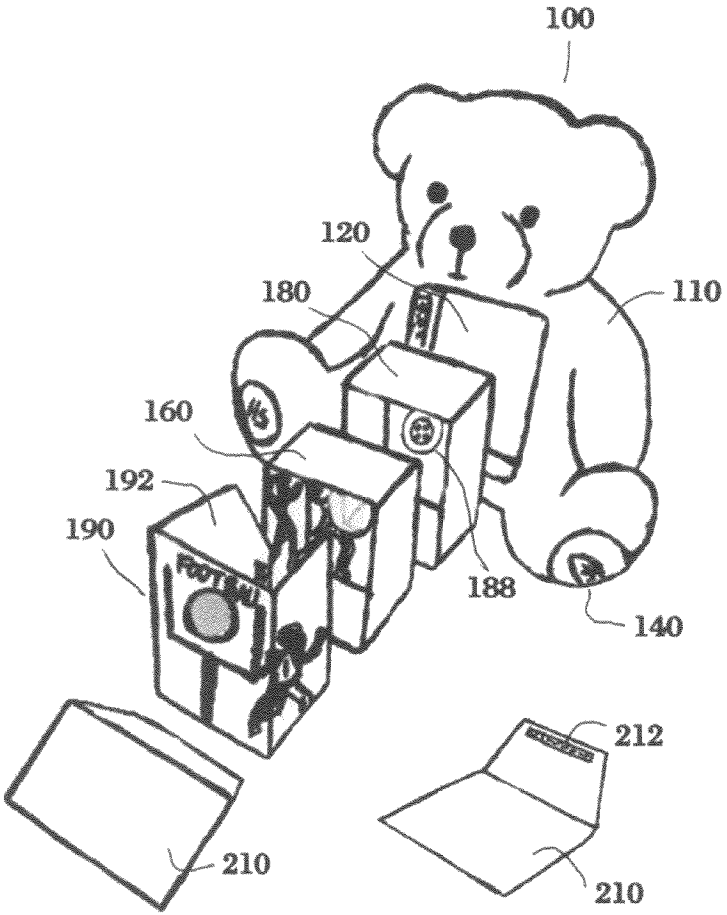
FIG. 12 is a front perspective view of the novelty toy accessory displaying an unassembled compartment changeable housing inserts assembly with its components and/or attachments, and two perspective front views of a detachable button or patch attached to the body of the novelty toy.

As shown in FIGS. 1-4 and 6, the novelty toy accessory 100 has a concealed basket compartment 120 or cavity with an elongated contoured shaped. The body 110 has a concealed basket compartment 120, cavity or opening in the chest-stomach area, as best seen in FIGS. 2-4 and 6, and a compartment changeable housing insert assembly 200 that can be placed inside of the concealed basket compartment 120 as best seen in FIGS. 9-12, 14-15C and FIG. 16C. A compartment changeable housing insert assembly 200 is comprised of several components within its housing assembly as best seen in FIG. 12. The compartment changeable housing insert assembly 200 has a changeable housing insert template 180 that can be placed, housed, secured or stored inside of the concealed basket compartment 120, cavity or opening in the chest-stomach area, as best seen in FIGS. 2-4 and 6. The changeable inner insert template 160 can be placed, housed, secured or stored inside of the changeable housing insert template 180. A detachable insert cover template 190 attaches to the fasteners 182 located on the rear end or back of changeable housing insert template 180, as best seen in FIG. 15B and FIG. 16C. The compartment changeable housing insert assembly 200 also has an optional insert ramp accessory 210 that can be affixed or attached to the fasteners 121 of the concealed basket compartment 120, as best seen in FIGS. 6, 11 and 12. A detachable cushion flap 130, best seen in FIGS. 1-2 and 5 attaches to the opening of the concealed compartment 120 or cavity. Thus, the detachable cushion flap 130 closes the opening to the concealed basket compartment 120 or cavity so that the concealed basket compartment 120 or cavity is essentially hidden.

As shown in FIGS. 1-3, 8, 11-12 and FIG. 15, the novelty toy accessory 100 includes detachable buttons 140 housed on its body 110. The detachable buttons 140 have Velcro 142A on the back side 140A of it to be affixed or attached to the Velcro patches 142 located on the novelty toy's body as best seen in FIGS. 3, 9, 13-15A and 17.

The body 110 may also be constructed into other various shape or forms, apart from an elongated sitting structure, such as without limitation a standing, prone, kneeling, horizontal or slanted position or posture. The body 110 may also be formed as any entertainer, holiday figure, symbol or icon, sports figure, mascot, bird, fish, two or four legged animal, reptile-like or humanoid character known or attractable to adults or children. The body 110 can also be made of plastic fabrication, without using fabric shell filling to place inside of the body 110. The sitting posture provides a center of gravity that allows the body 110 to sit in an upright position on a horizontal surface.

The concealed basket compartment 120 is embedded within the body 110 of the novelty toy accessory 100. As best seen in FIG. 6, the concealed basket compartment 120 has several corners 122 with flat surfaces 124 to form a generally box shaped cavity to rest the novelty item 150 therein. The cavity shape should be arranged such that it tracks the shape of the novelty item.

Figure 4:
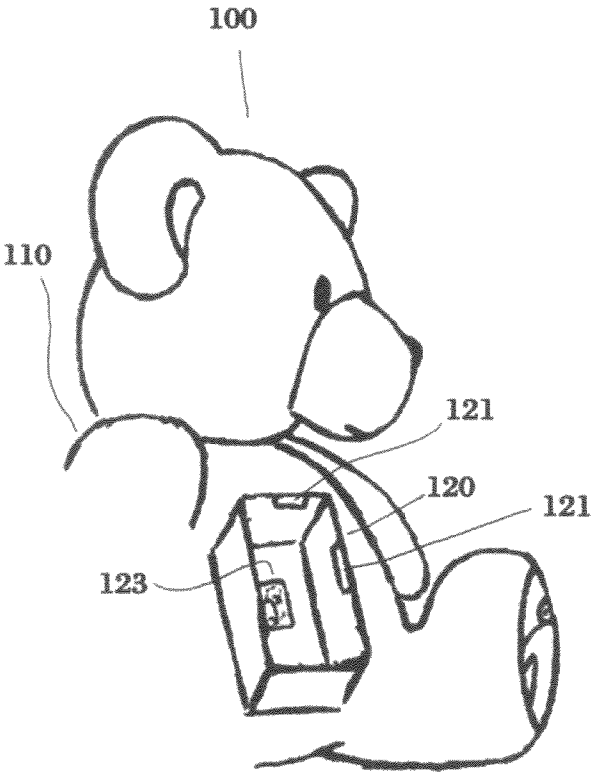
FIG. 4 is a partial perspective view of the novelty toy accessory displaying a perspective view of the concealed basket compartment within the body cavity of the toy accessory.
Figure 3:
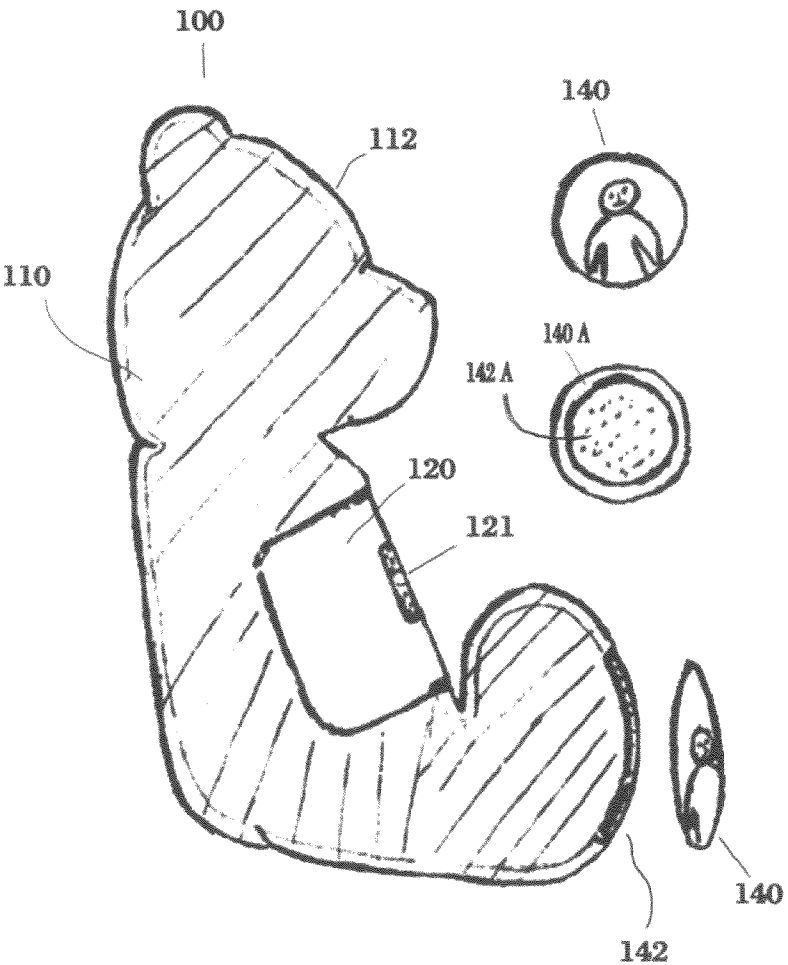
FIG. 3 is a cross-sectional view along the plane of FIG. 2 and a partial perspective, back view and front view of detachable button or patch unattached from the body of the novelty toy.

As best seen in FIGS. 3-4 and FIG. 6, the concealed basket compartment 120 or cavity also has several inner internal fasteners 121 used to close, fasten and secure fasteners 132 of the detachable cushion flap 130 over the opening to the concealed basket compartment 120 or cavity and attach or secure the insert ramp accessory 210. Fasteners 121 and fasteners 132 may be hook and loop fasteners, Velcro, a zipper, etc. In the center part of the concealed basket compartment 120 or cavity is a stuffing insert opening 123 for a stuffing filling device (not shown) to pass through to fill the novelty toy with the assigned filling, as best seen in FIGS. 6-7.

Figure 7:
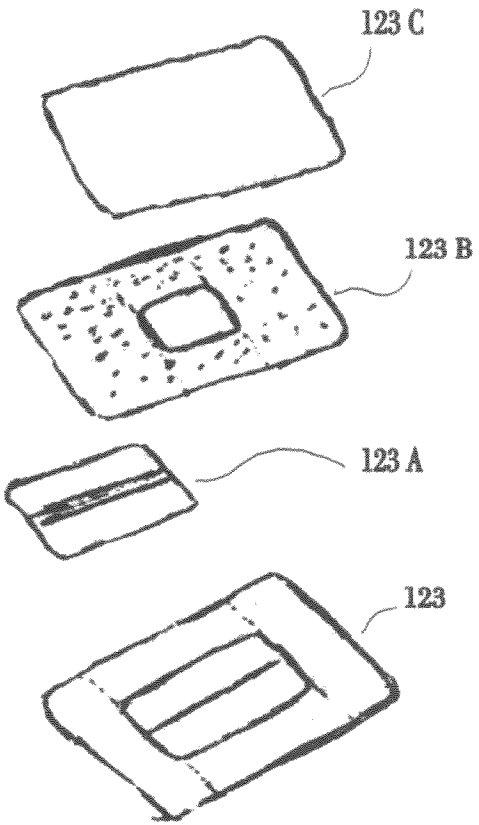
FIG. 7 is a top perspective view of the stuffing insert opening components or parts that is located inside of the concealed basket compartment.

As best seen in FIG. 7, the stuffing insert opening 123 is comprised of several parts for receiving a stuffing filling device (not shown). The stuffing insert opening 123 has a retractable opening slot 123A on the center flat surface 124 of the conceal basket compartment 120, as best seen in FIG. 6. Surrounding the retractable opening slot 123A, is a surface fastener 123B designed to attach to the stuffing insert cover 123C, as best seen in FIG. 7. Fasteners 123B and fasteners 123C may be hook and loop fasteners, Velcro, or zipper, etc.

The concealed basket compartment 120 is designed to hold a compartment changeable housing inserts assemblies 200, traditional and conventional gift basket trinkets or items used for but not limited to, floral arrangements, fruits, baby or infant items, games, school supplies, arts and crafts, jewelry, clothing, toys, edible foods for humans, pets and/or gift novelty items 150 securely in place. To show each novelty item is prohibitive. However, in FIG. 1, the exemplary embodiment of the gift or novelty items is a gift basket assembly set 150. As seen in FIG. 2, the gift basket assembly 150 includes a photo album 151, a digital camera 152, a jewelry box 153 and a box of chocolates 154.

The concealed basket compartment 120 or cavity can be made of any resilient materials, such as without limitation, plastic, fabric, rubber, weave or wicker material. The concealed basket compartment 120 or cavity may also be constructed into other various shapes or forms, apart from a rectangular shape, such as without limitation, a square, oval, circle, heart, clover, star, octagon or animal shape. It can be made of Styrofoam, rubber, fabric, foam, weave, wicker or metal material. The insert opening 123 may also be place in a different place or section of the body 110. The concealed basket compartment 120 or cavity can also feature a permanent or fixed cushion flap in lieu of the detachable cushion flap 130 that allows access to the concealed basket compartment 120 or cavity.

Figure 10:
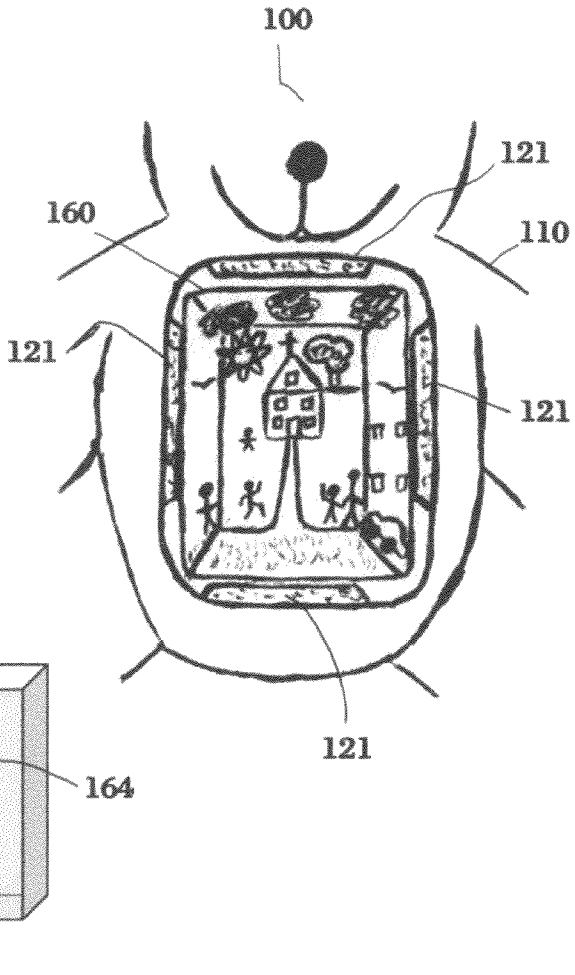
FIG. 10 is a front view of the novelty toy accessory displaying the opening of the concealed basket compartment showing a changeable inner insert template.
Figure 9:
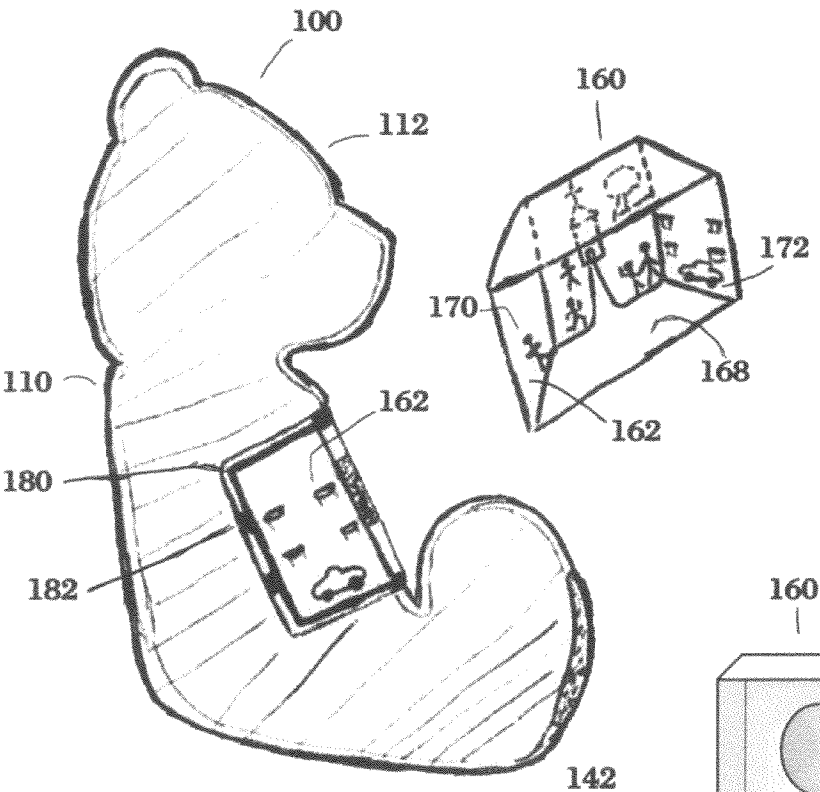
FIG. 9 is a cross-sectional view along the plane of FIG. 4 and a partial perspective, back view and front view of a changeable inner insert template within the novelty toy's body and two exploded front perspective views unattached from the body of the novelty toy.
Figure 11:
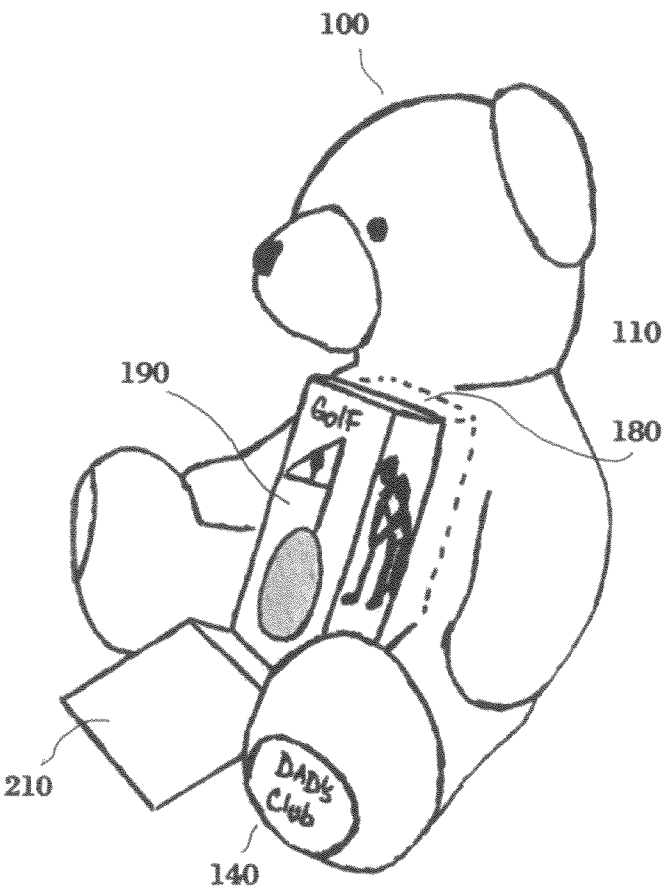
FIG. 11 is a front perspective view of the novelty toy accessory displaying an assembled changeable housing insert template affixed inside of the novelty toy's compartment cavity, and a perspective front view of a detachable button or patch attached to the body of the novelty toy.
Figure 14:
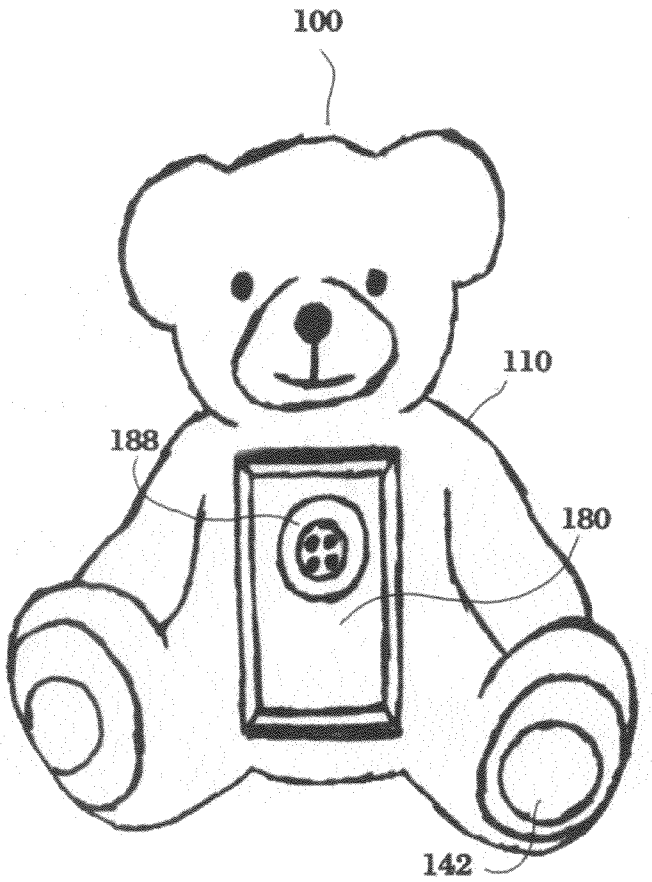
FIG. 14 is a front view of the novelty toy accessory displaying a changeable housing insert template with a light source attached or affixed inside of its cavity, both being inside of the body of the novelty toy.
Figure 13:
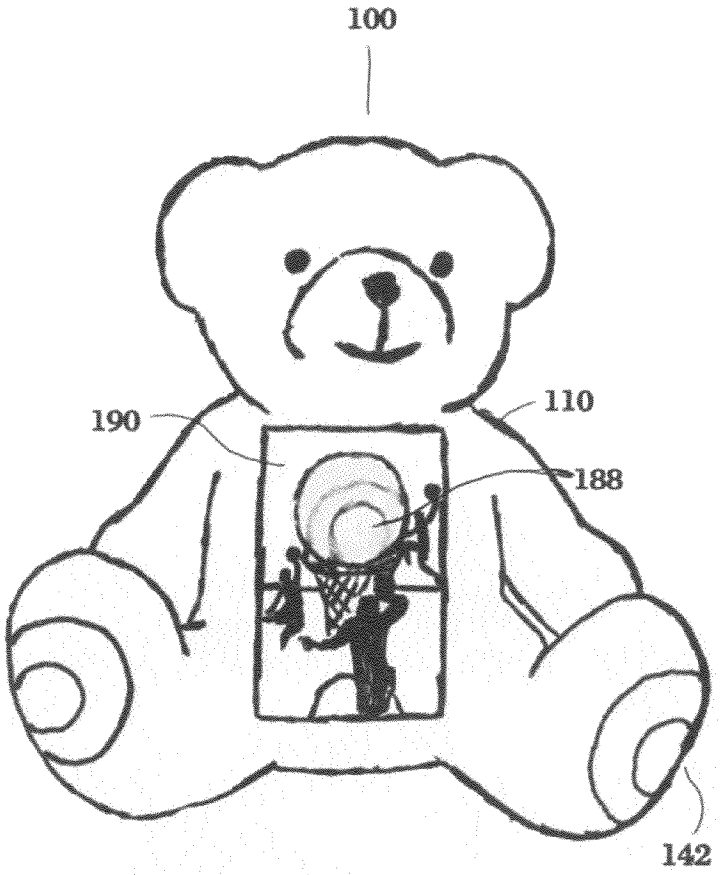
FIG. 13 is front views of the novelty toy accessory displaying an assembled compartment changeable housing insert assembly with its components and/or attachments.

As best seen in FIGS. 9 and 10 the concealed basket compartment 120 is embedded within the body 110 of the novelty toy accessory 100, to optionally receive a changeable housing insert template 180, as best seen in FIG. 9, 12 and FIGS. 14-15C. The changeable housing insert templates 180 is made of any of the following including but not limited to, cardstock, chipboard, cardboard, plastic or vinyl sheets, and has several corners 184 with flat surfaces 186 to form a generally box shaped cavity to place an optionally changeable inner insert template 160, or novelty items 170 therein as best seen in FIGS. 9-10, FIG. 12 and FIG. 15A. On the outer backside of the changeable housing insert template 180, are two fasteners 182 use to affix or attach the insert cover 190 fasteners securely to its embodiment, as best seen in FIGS. 9 and 16A-16C. The changeable housing insert template 180 also has an optional light source 188 as best seen in FIG. 14, affixed inside of its cavity or compartment. The light source 188 can be used for various settings including but not limited to, traditional or conventional games, night lights, or giving illumination to novelty items placed inside of the changeable housing insert template 180. The cavity's shape can be optionally arranged such that it tracks the shape of the novelty item and allows the closure of the detachable cushion flap 130 over the opening to the concealed basket compartment 120 or cavity.

The changeable housing insert template 180 or cavity can also be made of any resilient materials, such as without limitation, foam, Styrofoam, fabric, rubber, and weave or wicker material. The changeable housing insert template 180 or cavity may also be constructed into other various shapes or forms, apart from a rectangular shape, such as without limitation, a parade float, carriage, vehicle, stage, aquarium, human or humanoid like figure, square, oval, circle, heart, clover, star, octagon or animal shape or mascot that are recognizable to children and/or adults. The changeable housing insert template 180 may also be place in a different place or section of the body 110.

As best seen in FIGS. 9-10 and FIG. 12, the changeable housing insert template 180 has an opening to accept a changeable inner insert template 160 in its compartment. The changeable inner insert template 160 has several corners 162 with flat surfaces 168 to form a generally box shaped cavity as seen in FIGS. 9-10 and FIG. 12. The changeable inner insert template 160 may have a circle, oval, square, rectangular cut or punched out shape 164 on the flat wall surface 166, to allow it to be placed over an optional light source 188 affixed inside of the changeable housing insert template 180 as best seen in FIG. 14.

The changeable inner insert templates 160 are designed in various templates including but not limited to, arts and crafts, religious functions, fairs, traditional and conventional learning games and activities, sporting templates for schools family, recreational, political, social and cultural activities or gatherings and one can place, house, secure, draw, paint, mount or store crafts and/or novelty items therein.

To show all items is prohibitive. However, in the exemplary embodiment, the novelty items 170 is a miniature toy or doll assembly set. The toy or doll assembly includes a miniature toy or doll family 170 and a toy car 172 resting or sitting inside of a going to church changeable inner insert template 160.

The changeable inner insert template 160 can be made of any resilient materials, such as without limitation, cardboard, chipboard, foam, plastic, fabric, paper, rubber, and weave or wicker material. The changeable inner insert template 160 may also be constructed into other various arts and crafts, diagrams, images, puzzles, shapes or forms, apart from a rectangular shape, such as without limitation, a square, oval, circle, heart, clover, star, octagon or animal shape. It can be made of Styrofoam, rubber, fabric, foam, weave, wicker or metal material. The changeable inner insert template 160 may also be place in a different place or section of the body 110. The concealed basket compartment 120 or cavity can also feature a permanent or fixed changeable inner insert template 160 in lieu of FIG. 9

As seen in FIGS. 11-13 and FIGS. 16-17I, is an insert cover template 190 that are made from a variety of individual materials for each template, the materials is, but not limited to paper, foam, stock cards, cardboard, chipboard, construction paper, transparency, adhesive backed materials such as foam, dry erase, glossy, matte or photo paper. Just to name a few. The Insert cover template 190 has an Octagon shape when laid on a flat surface. When folded it forms a partial rectangular shape that allows it to be attached to fasteners 182 located on the rear outer surface of the changeable housing insert template 180 as best seen in FIGS. 16A-16C. The insert cover template 190 has two magnetic fasteners 194 located on its inner flap 192 used to attach or affix the insert cover template 190 over the opening of the changeable housing insert template 180, as seen in FIG. 16B.

Figure 17A:
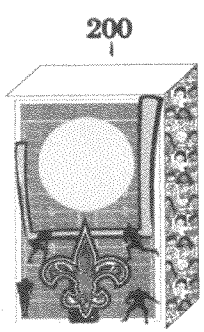
Figure 17B:
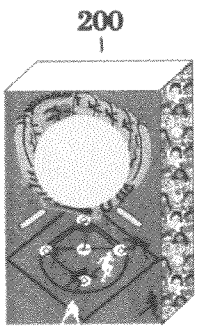
Figure 17C:
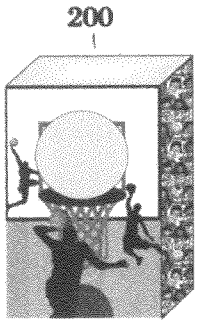
Figure 17D:
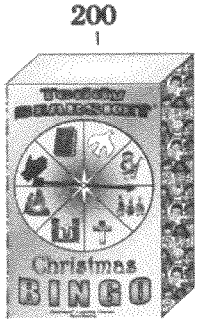
Figure 17E:
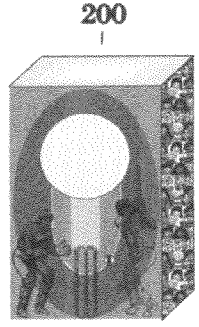
Figure 17F:
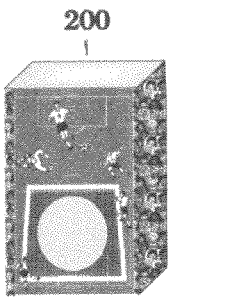
Figure 17G:
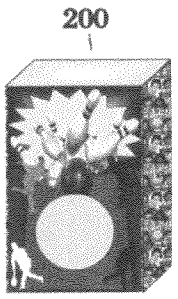
Figure 17H:
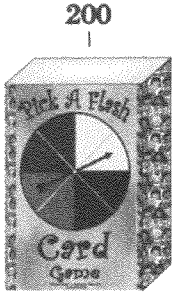
Figure 17I:
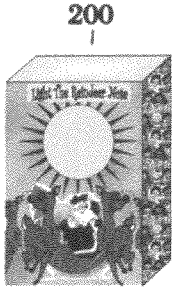
Figure 17:
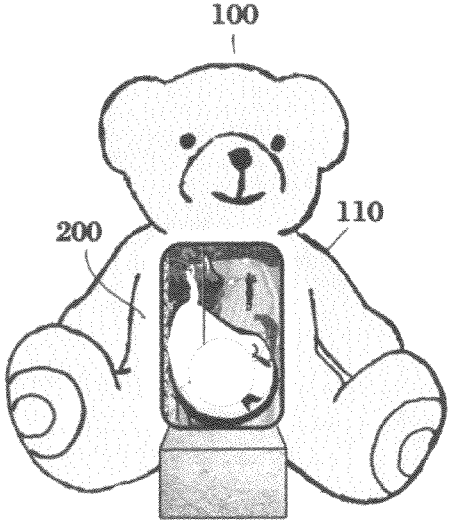
FIG. 17 is a front view of the novelty toy accessory displaying a fully assembled Compartment Changeable Housing Insert Template with its Insert Ramp attached inside of the body of the novelty toy.

The insert cover template 190 is designed in various templates including but not limited to, game templates for arts and crafts activities, holiday or religious games, fairs, Mardi Gras, festivals, traditional and conventional learning games and activities such as but not limited to, "bingo", "flash cards", "tic-tac-toe", "pin the tail on the . . . ", or various sporting templates including but not limited to, football, baseball, basketball, cricket, golf, bowling, dartboard and/or soccer just to name a few, as best seen in FIGS. 17-17I. Other designs included are chalk or white board surfaces, clear or printed transparencies, embellishments or magnetic crafts accessories attached to its surface, paintings, drawings for family and schools, recreational, political, social and cultural activities imprinted on its surface.

The insert cover template 190 can be formed into other shapes are images such as square, circle, oval, holiday symbol, icon, mascot, humanoid or any other character recognizable or known to children or adults. The insert cover template 190 can be formed into the image of any animal-like, holiday symbol, icon, mascot, humanoid or any other character recognizable or known to children or adults. The insert cover template 190 can also be designed to attach in a horizontal position. The insert cover template 190 may also be constructed into other various shapes or forms, apart from a rectangular shape, such as without limitation, a square, oval, circle, clover, heart, star, octagon or animal shape.

The insert cover template 190 may also be formed as any alphabet, number, bird, fish, two or four legged animal, reptile-like or any humanoid character known or attractable to adults or children, the character could include any that are attractable to adults or children, such as without limitation, Entertainers, Sport Figures/Icons, mascots, Holiday Figures/Icons, Mickey Mouse, Winnie the Pooh, Bugs Bunny, Big Bird, Barney, SpongeBob SquarePants, or any other characters created by Walt Disney, Inc., Warner Brothers, Public Broadcasting Service (PBS), or Nickelodeon.

As best seen in FIGS. 11-12, is an insert ramp accessory 210 made or designed from a variety of individual materials for each ramp such as, but not limited to, paper, stock cards, cardboard, chipboard, construction paper, plastic, adhesive backed materials such as foam, dry erase, glossy, and matte or photo paper. Just to name a few. The insert ramp accessory 210 is a detachable accessory that has a partial trapezoid or pyramid shape. The insert ramp accessory 210 is attached or affixed securely by its fasteners 212 as best seen in FIG. 12, to the concealed basket compartment's 120 lower internal fasteners 121. The function or purpose of the insert ramp accessory 210 is to allow a rolling object such as a marble or ball to be rolled inside the compartment changeable housing insert assembly 200. The insert ramp accessory 210 can be formed into other shapes are images such as square, circle, oval, holiday symbol, icon, mascot, humanoid or any other character recognizable or known to children or adults. The insert ramp accessory 210 can be formed into the image of any animal-like, holiday symbol, icon, mascot, humanoid or any other character recognizable or known to children or adults. The insert ramp accessory 210 may also be constructed into other various shapes or forms, apart from a rectangular shape, such as without limitation, a square, oval, circle, clover, heart, star, octagon or animal shape. The insert ramp accessory 210 may also be formed as any alphabet, number, bird, fish, two or four legged animal, reptile-like or any humanoid character known or attractable to adults or children.

Figure 5:
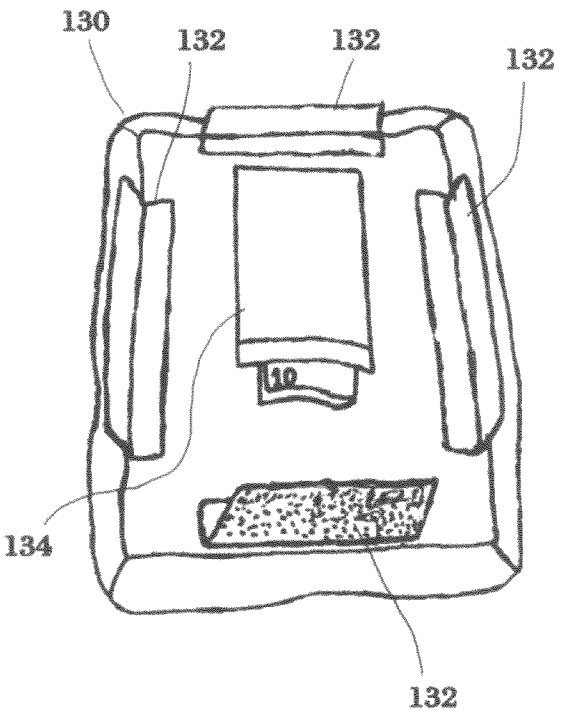
FIG. 5 is a rear view of the detachable cushion flap displaying the external fasteners and an inner secret pocket to store items.
Figure 8:
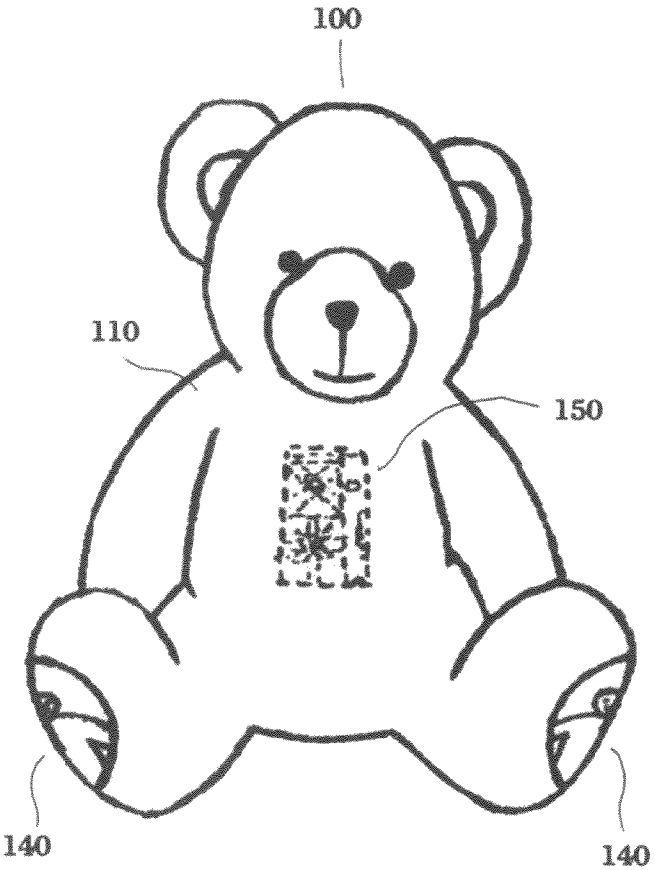
FIG. 8 is a front perspective view of the novelty toy accessory displaying the diagram of housed, stored, packaged, secured and/or concealed gifts or novelty items in its body.

As seen in FIG. 5, the detachable cushion flap 130 is a rectangular shape structure similar to that of a pillow uses to rest ones head on. The detachable cushion flap 130 is made from safe material suitable for the usage by children, material may be, such as without limitation, vinyl, faux fur, fabric shell with filling, foamed rubber, polyurethane, or other fitting material generally used in the manufacturing of stuffed or plush toys. The detachable cushion flap 130 has on its inner side several external fasteners 132 used to secure, fasten or attach to the internal fasteners 121 located around the perimeter of the concealed basket compartment 120. Also located on the inner side of the detachable cushion flap 130 is an inner pocket 134 to store gift items, remote control, ID cards, keys, folded letter or notes etc. The outer side or surface of the detachable cushion flap 130 has faux material or similar to the body 110 of the novelty toy accessory 100. When attached and closed over the opening of the concealed basket compartment 120, the detachable cushion flap 130 helps protect, secure, hide and/or conceal the novelty item.

The detachable cushion flap 130 can be formed into the image of any animal-like, holiday symbol, icon, mascot, humanoid or any other character recognizable or known to children or adults. The detachable cushion flap 130 can also be open to a horizontal position. The detachable cushion flap 130 may also be constructed into other various shapes or form, apart from a rectangular shape, such as without limitation, a square, oval, circle, clover, heart, star, octagon or animal shape.

The detachable cushion flap 130 may also be formed as any alphabet, number, bird, fish, two or four legged animal, reptile-like or any humanoid character known or attractable to adults or children, the character could include any that are attractable to adults or children, such as without limitation, Entertainers, Sport Figures/Icons, mascots, Holiday Figures/Icons, Mickey Mouse, Winnie the Pooh, Bugs Bunny, Big Bird, Barney, SpongeBob SquarePants, or any other characters created by Walt Disney, Inc., Warner Brothers, Public Broadcasting Service (PBS), or Nickelodeon.

As shown in FIGS. 1-4 and 8 of the drawings, the novelty toy accessory 100 displays detachable buttons 140 that are attached or detached from its body 110. These detachable buttons 140 are securely attached to the body 110 by having a compatible component to attach to and detach from the body 110. FIG. 3, for example shows a Velcro patch permanently attached to the surface of the body 110, to receive and secure the Velcro backed button 142A portion. The Velcro patch 142 on the surface of the body can be sewn or glued, as best seen in FIG. 3. The detachable button can be removed and placed inside of the concealed basket compartment 120 or the inner pocket 134 located on the rear side of the detachable cushion flap 130. The detachable buttons 146 have an oval, rectangular or circle shape and made of any resilient materials, such as without limitation, metal, embroidery, fabric, plastic or rubber.

The detachable buttons 140 may also be constructed into other various shapes or form, apart from an oval, rectangular or circle shape, such as without limitation, alphabet(s), number(s), square, star, circle, heart, pyramid, octagon, or holiday/icon shape, and can be made of light weight Styrofoam, rubber, plastic, foam, fabric, paper, wood or metal material. The buttons 140 may also be place in different places or parts of the body 110.

The novelty toy accessory 100 has multiple functions such as but not limited to the use of displaying a gift basket that is housed inside of a plush toy that can hold, secure, package, and/or conceal gift basket items. These item may include but not limited to, boxed chocolate or candies, floral arrangements, fruit or other edible foods, coffee packets, infant or baby toys or accessories, wedding favors, and/or special or holiday items. The novelty toy accessory 100 also functions as multifunctional stuffed or plush toy having changeable inserts templates for those settings involving educational and sporting games that features multiple traditional game activities in one setting along with the option of flexibility for, such as but not limited to, arts and crafts, "bingo", "flash cards", "tic-tac-toe", playing marbles, "toss the bean bag", "pin the tail on the . . . ", football, baseball, basketball, cricket, golf, bowling, hockey, dartboard and/or soccer, all with one novelty toy. The novelty toy accessory 100 features a variety of assorted insert templates including an insert ramps to be exchanged or used for learning and educational settings, parties, tailgating games, sporting activities, social and cultural events.

The novelty toy accessory 100 is arranged to removably house or conceal both the gift and/or novelty items 150. On the other hand, the novelty toy accessory 100 can be used a game learning activity, arts and crafts or game accessory companion housed into a multifunctional novelty toy accessory 100.

The user first determines the desired use or function of the present invention, such as a gift basket or to use for a learning or game toy. If the user chooses to use the novelty toy accessory 100 as a gift basket, the user can leave the changeable housing insert assembly 200 separate from the novelty toy's body.

Once the user gathers the desired novelty items to place inside of the basket compartment 120, the user will have the option to close or leave open the detachable cushion flap 130 pending on how full the basket compartment 120 is filled.

If the user decides to use the novelty toy as a learning or game accessory, the user first determines which compartment changeable housing insert assembly 200 to play with. If the user chooses a football template as seen in FIG. 17A, the user first inserts the compartment changeable housing insert assembly 200 into the basket compartment 120 the user will noticed that the compartment changeable housing insert assembly 200 will fit snuggly inside of novelty toy accessory's 100 basket compartment 120. This is to prevent the compartment changeable housing insert assembly 200 from falling out when placed in an upright or sitting position. The user can use soft ball shape items to toss in the opening hole or punched out circle located on the surface of the insert cover template 190. If a ball is made inside of the compartment changeable housing insert assembly 200, the user can use his or her hand to take the ball out. All users can come up with their own scoring or point system.

Once the user is finished playing with the novelty toy accessory 100, the novelty toy can be unassembled by taking the compartment changeable housing insert assembly 200 out or leaving it in the basket compartment to play at a later time.

The novelty toy accessory 100 is constructed and arranged to package, house and secure novelty items, arts and crafts or compartment changeable housing insert assembly 200.

As can be appreciated, removing the gift or novelty item can be removed from the concealed basket compartment or inner pocket to be enjoyed separately or in combination and/or placed back inside independently if desired.

Again referring now to FIG. 6, the stuffing insert opening 123 is preferably for using a stuffing filling device (not shown) when stuffing the novelty toy 110 with proper filling in manufacturing and/or activities involving individual or group participation such as but not limited to, parties, fundraisers, profit or non-profit organizations, craft shows or fairs, schools, clubs, parks, colleges and/or professional associations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A toy body having a concealed compartment for securing or housing a removably changeable housing insert assembly forming a cavity, the toy comprising: a compartment embedded within the body of the toy having a rear wall, the rear wall having an opening for adding and removing stuffing from the toy body, a changeable housing insert template with a rear wall to be removably received and nested within the compartment, a changeable inner insert template with a rear wall to be removably received and nested within the changeable housing insert template, a detachable changeable insert cover template that is removably attached to the changeable housing insert template and used to enclose a cavity created by the combined and nested housing and inner insert assembly, an insert ramp accessory that is removably attached to a lower portion of the changeable housing insert template at a location proximate the outside of the body, the changeable housing insert template and the changeable inner insert each further comprising an opening in a wall to accommodate a light source running from the body to the cavity, the body further comprising a removably detachable cover used to conceal the cavity or nested changeable housing insert assembly, the changeable housing insert assembly formed with indicia including but not limited to arts and crafts, learning or educational games, traditional family or social games, sport activity games.

2. The toy body of claim 1, wherein the toy body comprises one of a stuffed toy animal, stuffed character, stuffed humanoid body, stuffed holiday figure, stuffed mascot, cushioned toy animal, cushioned humanoid body, cushioned character, cushioned holiday figure, or cushioned mascot.

3. The toy body of claim 1, wherein the cavity section is used to receive, store, house, or package gifts, novelty items or accessories thereof that are traditionally and/or conventionally placed inside gift baskets.

4. The toy body of claim 1, wherein the removably detachable cover conceals the cavity or nested changeable housing insert assembly when the cover is attached to the body and reveals the cavity or nested changeable housing insert assembly when detached from the body and further wherein the removably detachable cover has a pocket on the inside surface such that items housed within the pocket are concealed when the cover is attached to the body.

5. The toy body of claim 1, wherein the cavity is used to removably display, store, house, package, conceal or secure the removably changeable housing insert assembly, the removably changeable housing insert assembly having indicia formed thereon including but not limited to arts, crafts, learning and traditional games, fundraising, corporate promotions and sports activities.

6. The toy body of claim 1, the toy body further comprising areas on the body for the detachable coupling of buttons with indicia representing displays, presentations, or expressions.

7. The toy body of claim 3, wherein the cavity is capable of storing gifts or novelty items.

8. The toy body of claim 3, wherein a removably detachable insert cover sheet is connected by fastener to the cavity rear wall to cover the opening for adding or removing stuffing.

9. The toy body of claim 2, wherein the cavity is located in the chest or stomach of the toy body and the cover is used to conceal the cavity or the changeable housing insert assembly.

10. The toy body of claim 4, wherein the removably detachable cover is capable of storing gifts or secondary novelty items inside the pocket.

11. The toy body of claim 3, wherein the cavity is located in the chest or stomach of the toy body and the cavity is used to store, package, secure, house, or conceal a gift, novelty item, portable electronic device, garment, jewelry, fragrance, collector's item, toy or game.

12. A toy body having a concealed compartment for securing or housing a removably changeable housing insert assembly forming a cavity, the toy comprising: a compartment embedded within the body of the toy having a rear wall, a changeable housing insert template with a rear wall to be removably received and nested within the compartment, a changeable inner insert template with a rear wall to be removably received and nested within the changeable housing insert template, a detachable changeable insert cover template that is removably attached to the changeable housing insert template and used to enclose a cavity created by the combined and nested housing and inner insert assembly, an insert ramp accessory that is removably attached to a lower portion of the changeable housing insert template at a location proximate the outside of the body, and the changeable housing insert template and the changeable inner insert each further comprising an opening in a wall to accommodate a light source running from the body to the cavity, the cavity also used for securing, housing and storing novelty items such as toys, arts and crafts and game accessories.

13. The toy body of claim 12, wherein the light source is used to illuminate items stored inside the cavity and/or may be turned on and off by the user.

14. The toy body of claim 12, wherein the changeable housing insert assembly comprises indicia in the form of photo graphics, arts and crafts and game templates used for activities or games, and wherein the changeable housing insert template and changeable inner insert template further comprise the opening aligned in each respective rear wall to accommodate the light source.

15. The toy body of claim 12, wherein the changeable insert cover template includes a main portion with game or activity images printed on the outside surface, at least one side flap extending from the main portion, and the at least one flap further including a fastener affixed to the inside portion of the flap and wherein the flap fastener detachably couples to a respective fastener located on the outside rear wall of changeable housing insert template in order to enclose the cavity.

16. The toy body of claim 13, wherein the insert ramp accessory is in the shape of a trapezoid and has a proximate end detachably coupled to the inside lower surface of the changeable housing insert template and a distal end resting on a different surface, the ramp allowing a rolling object such as marbles or balls to enter the cavity from the different surface via the ramp.

17. The toy body of claim 15, wherein the insert cover template, including specifically the main portion, may comprise various shapes and indicia designs, including but not limited to indicia themes of arts and crafts activities, holiday or religious games, fairs, carnivals, Mardi Gras, parade floats or masks, festivals, chalk or white board surfaces, clear or printed transparencies, magnetic crafts and accessories therein, paintings, family or school drawings, recreation, corporate promotions, political, social and cultural activities, traditional and conventional learning games and activities including: bingo, flash cards, tic-tac-toe, pin the tail on the animal, and various sporting themes including: football, baseball, basketball, cricket, golf, bowling, hockey, dartboard and soccer.

18. The toy body of claim 14, wherein the changeable inner insert template, including specifically the rear wall, may comprise various shapes including but not limited to a rectangle, square, oval, circle, heart, clover, star, octagon or animal shapes and may also include indicia designs, including but not limited to themes of diagrams, photos, images, puzzles.

* * * * *